US005484323A

United States Patent [19]

Smith

[11] Patent Number: 5,484,323

[45] Date of Patent: Jan. 16, 1996

[54] BELT CLEANER

[76] Inventor: Robert K. Smith, 52 Drayton Street, Bowden, 5007, Australia

[21] Appl. No.: 185,793

[22] PCT Filed: Jul. 22, 1992

[86] PCT No.: PCT/AU92/00373

§ 371 Date: May 5, 1994

§ 102(e) Date: May 5, 1994

[87] PCT Pub. No.: WO93/01896

PCT Pub. Date: Feb. 4, 1993

[30] Foreign Application Priority Data

Jul. 22, 1991 [AU] Australia ..... PK7332

[51] Int. Cl.[6] ..... B24B 53/10

[52] U.S. Cl. ..... 451/10; 451/6; 451/56; 451/296; 451/444

[58] Field of Search ..... 51/262 R, 262 A, 51/135 R, 325, 165.72, 165.76, 165.77; 125/11 R; 15/210 R, 223, 244.3

[56] References Cited

U.S. PATENT DOCUMENTS

| | | | |
|---|---|---|---|
| 3,753,269 | 8/1973 | Budman | 51/262 A |
| 4,356,671 | 11/1982 | Gabrielson et al. | 51/325 |
| 4,720,939 | 1/1988 | Simpson et al. | 51/262 A |

FOREIGN PATENT DOCUMENTS

| | | |
|---|---|---|
| 73180 | 11/1987 | Australia . |
| 25632 | 1/1990 | Australia . |

OTHER PUBLICATIONS

WO,a, 81/0080 (Smith) 16 Apr. 1981 entire document.

*Primary Examiner*—Bruce M. Kisliuk
*Assistant Examiner*—Eileen Morgan
*Attorney, Agent, or Firm*—Cushman Darby & Cushman

[57] ABSTRACT

A cleaner for attachment to a wide belt sander, the cleaner being mounted adjacent the top roller of the belt sander. The cleaner is applied to the sanding belt only during operation of the sander.

7 Claims, 2 Drawing Sheets

BELT CLEANER

This invention relates to an abrasive belt cleaner, more particularly to the cleaning of the abrasive belt in a wide belt sanding machine.

BACKGROUND OF THE INVENTION

In belt sanders, it is well known that after a period of operation the surface of the abrasive belt becomes loaded or filled with particles of wood and also the resins of the wood, and in fact the belt becomes glazed and virtually ineffective in operation.

One solution to this problem has been to close down the machine, remove he belt and replace the belt with a new belt, the old belt being discarded. Chemical cleaning is also known, but the most common method of cleaning the belt is to apply a block of synthetic or natural rubber, preferably crepe rubber to the surface of the belt with relative motion between the belt and the block of rubber. For small sanders, the block of rubber can be hand held, but in commercial situations and particularly for wide belt sanders it is not practical and can be a dangerous action to hold the block of rubber against the sanding belt.

BRIEF DESCRIPTION OF THE PRIOR ART

One example of the use of a block of rubber is shown in U.S. Pat. No. 4,356,671 in which the rubber block is mounted in a frame which is periodically passed through the sanding machine. Thus, the sanding operation must be interrupted and the block of rubber passed through the machine in place of a piece of wood. However, the tendency with this practice is that the operators tend to permit to pass by the maximum time between cleaning of the belt, and thus the belt can become excessively loaded, and more than one pass of the rubber block may be necessary for effective cleaning. This is loading of the belt can be detrimental to the life of the belt, and also the cleaning is time consuming.

Australian Patent Application No AU-73180/87 shows a belt cleaning device attached exteriorly to a wide belt sander which can automatically contact the cleaning block on the abrasive belt during operation of the belt sander for selected periods of time. The cleaning block is mounted in a holder and there is provided a means for withdrawing the block from the belt, and further means for advancing the block into contact with the belt, the further means thus overcoming the force of the withdrawing means. The movement of the cleaning block can be controlled by a timer, or by a programmable controller, but when the sanding machine is not operative the cleaning block may be in contact with the belt and provision is made to withdraw the cleaning block on starting of the machine.

SUMMARY OF THE INVENTION

It is an object of this invention to provide a sanding belt cleaning unit which overcomes one or more of the disadvantages of the prior art units.

It is a further object of the invention to provide a belt sanding cleaning unit which is attached interiorly of the belt sanding machine.

It is a still further object of the invention to provide a belt cleaning unit in which the cleaning block is not in contact with the sanding belt when the sanding machine is not operative.

It is a further object of the invention to provide a belt sander cleaning unit which while automatic in operation is of simple and economical construction.

There is provided according to the invention a unit for cleaning the abrasive surface of a moving sanding belt, this unit comprising a frame for mounting on the interior of a casing of a belt sanding machine adjacent the moving belt, the frame mounting at least one air operated cylinder, the cylinder actuating a lever to which is attached a holder for the cleaning block, an actuator for the actuation of the cylinder upon the passage of material to be sanded passing through the sanding machine upon that on actuation of the cylinder the cleaning block moves into contact with the surface of the moving abrasive belt.

BRIEF DESCRIPTION OF THE DRAWINGS

In order to more fully describe the invention, reference will now be made to the accompanying drawings in which.

DESCRIPTION OF THE PREFERRED EMBODIMENT

Figure 2:
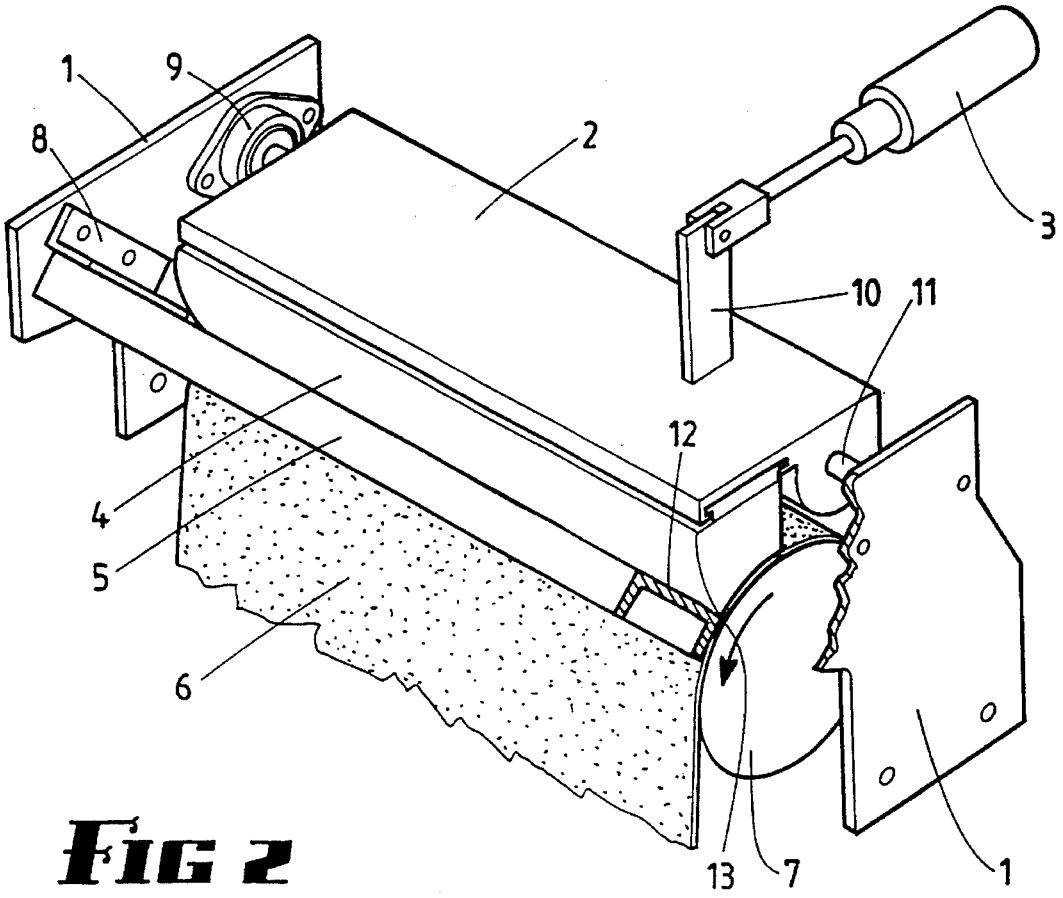
FIG. 2 is a view of the belt cleaning unit.
Figure 3:
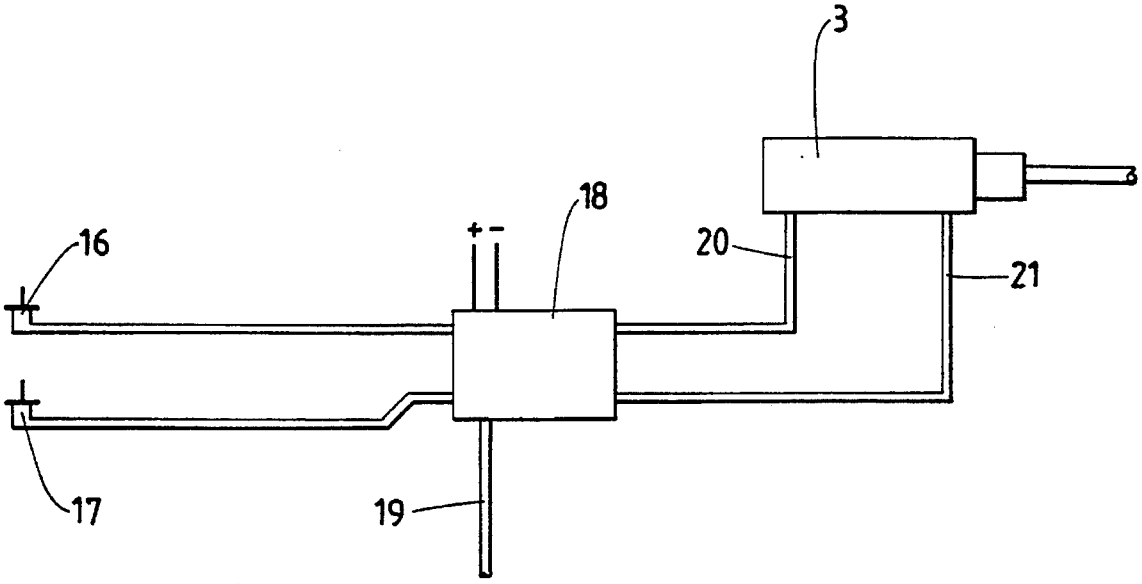
FIG. 3 is a view of the control system for the movement of the cleaning block.

Referring to FIG. 2 of the drawings, the belt cleaner comprises a pair of support brackets 1 which carry the cartridge holder 2 which is connected to a air cylinder 3 by an arm 10. The cartridge holder 2 holds the cleaning cartridge 4 which, as shown, is applied to the surface of the abrasive belt 6 which passes over the top roller 7 of the sanding machine. A cartridge support beam 5 is positioned so that it engages the trailing edge of the cleaning cartridge to prevent or substantially eliminate any vibration of the rubber cartridge, the cartridge support beam 5 being carded by beam support brackets 8 attached to the support brackets 1. The cartridge holder is supported on axles 11 mounted in bearings attached to the support brackets 1.

The right hand bracket 1 as shown in FIG. 2 is cut away, so that the relationship between the cleaning cartridge 4 and the top roller 7 can be seen. The cartridge is shaped and positioned so that the cleaning pressure can be applied radially to the roller. The support beam 5 has its surface 12 disposed generally radially of the roller and is positioned so that its longitudinal edge 13 would contact the surface of the cartridge 4 immediately adjacent the surface of the belt 6. Thus, the axle 11 of the cartridge holder is displaced laterally of the axis of revolution of the upper roller 7 so that the cartridge is then applied generally radially to the roller 7.

Figure 1:
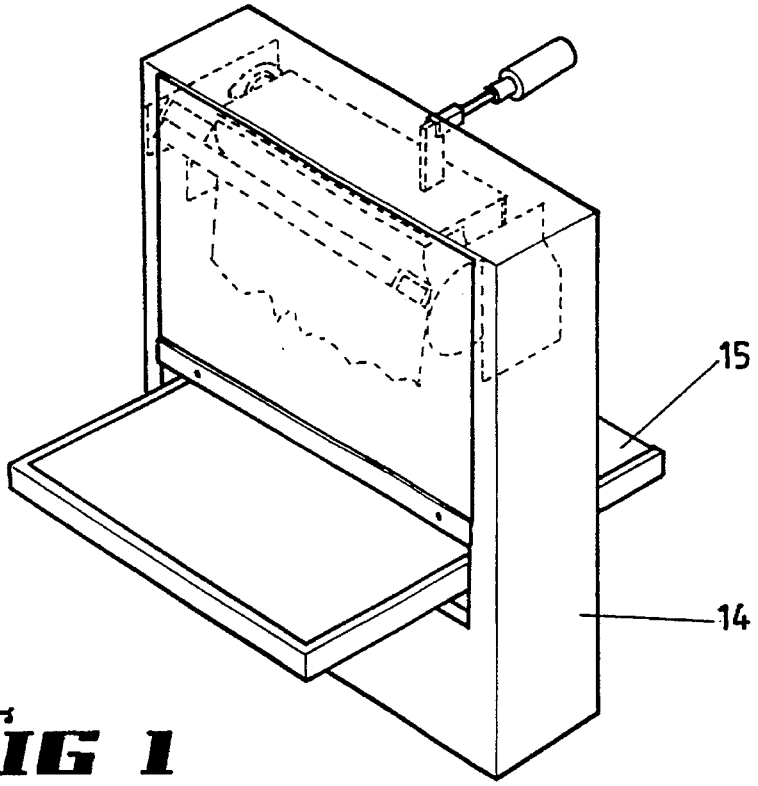
FIG. 1 shows a wide belt sanding machine with the cleaning unit being shown in dotted lines.

As shown in FIG. 1, the unit is attached to a sanding machine. When the unit is attached, the support brackets are bolted to the top roller bearing housings, or to the top roller supporting beam, and so the unit oscillates with the top roller to thus remove the possibility of vibration. It is common practice for the upper roller to be mounted in such a manner that the roller can oscillate. This is necessary to ensure that the belt tracks correctly on the rollers, The movement of the belt is sensed by sensors, and, when it runs off track, the sensors are connected to means which then cause the bearings on which the roller is mounted to be adjusted to tilt the roller so that the belt is caused to track back to its correct position. Thus, as the cleaning unit is mounted on the bearing housings of the top roller, the cleaning unit will thus move with the roller, so ensuring that the pressure of the cleaning unit is applied evenly along the whole length of the roller.

In accordance with the invention, the cleaning unit is only applied to the abrasive belt when desired, preferably during a sanding operation. Thus, there is provided on the sanding machine, preferably on the feeding table 15 a photoelectric switch to detect the timber as it exits the sanding operation. This switch is connected to a controller 18 supplied with compressed air through air supply line 19. The controller 18 then supplies compressed air through lines 20 and 21 to the air cylinder 3. Thus, when the machine is stationary or when it is operating, the cleaning cartridge is held away from the abrasive belt. However, when material to be sanded is presented to the machine the exit switch is activated so that the air cylinder moves to apply the cleaning cartridge to the abrasive belt. The photoelectric switch has an adjustable timer built in. After the predetermined timer has elapsed the switch cuts out, which will cause the cleaning cartridge to be retracted. In this way, the belt is continually cleaned only when the machine is actually sanding; the belt is kept continually clean, thus greatly extending the life of the belt.

As shown in FIG. 1, the cleaning unit is mounted inside the casing of the sanding machine, and the only requirement is that a small opening be made in the top cover so that the arm 10 will pass through to be connected to the air cylinder which can be mounted on a suitable bracket (not shown) attached to the sander, although in many cases the air cylinder can be made to fit inside the sanding machine casing.

While the cleaning unit is preferably operated automatically, it is to be realized that the belt cleaner can be operated manually. All that is required is that the fluid cylinder be provided with a manual air valve which can be operated as desired to clean the sanding belt, or a series of mechanical levers can be used to replace the air cylinder.

Thus, it can be seen that there is provided according to the invention a belt cleaner for a wide belt sander. The unit can easily be modified for various makes of sanders, and the cleaning cartridge can easily be replaced by sliding out the used cartridge from the holder and inserting a new cartridge. This can easily be done via a removable panel on the sanding machine, or a closable opening in the casing of the machine.

It is to be noted that while the invention is a cleaning unit which can be supplied and attached to existing belt sanders, belt sanders can be produced which have the cleaning unit fitted thereto during the production thereof.

Although one form of the invention has been described in some detail, it is to be realized that the invention is not to be limited thereto, but can include variations and modifications falling within the spirit and scope of the invention.

I claim:

1. A cleaning unit for cleaning an abrasive surface of a moving sanding belt in a sanding machine having a casing, said unit including:

a cartridge holder containing a cleaning cartridge for mounting in the interior of said casing of the sanding machine adjacent said moving sanding belt;

at least one fluid-operated cylinder connected to said cartridge holder;

sensing means provided on said belt sander to sense passage of material through said belt sander; and means actuated by said sensing means for actuating said cylinder upon the passage of material to be sanded passing through the sanding machine, so that upon actuation of the said cylinder, said cleaning cartridge moves to contact the said moving sanding belt.

2. A cleaning unit for cleaning an abrasive surface of a moving sanding belt in a belt sander having a casing and having an entry end and an exit end, said unit including:

a cartridge holder containing a cleaning cartridge for mounting in the interior of said casing of said belt sander adjacent said moving sanding belt;

at least one fluid-operated cylinder connected to said cartridge holder;

means to actuate said cylinder to apply said cleaning cartridge to said moving belt;

a control unit operated by microswitches or photoelectric switches positioned upon a selected one of the entry or exit ends of the belt sander for controlling said cylinder so that said cleaning cartridge is only applied to said sanding belt during a sanding operation.

3. The cleaning unit defined in claim 2, wherein:

said cleaning belt passes over a top roller supported by bearings in bearing housings; and said cartridge holder is mounted to said bearing housings so that the cartridge holder oscillates therewith.

4. The cleaning unit defined in claim 2, wherein:

said cleaning cartridge is removably positioned in said cartridge holder, the cartridge holder being pivoted in bearings fixed to a support bracket mounted on a steel beam supporting a top roller over which said sanding belt passes.

5. The cleaning unit defined in claim 4 wherein:

said cleaning cartridge is applied to the sanding belt generally radially of the top roller over which the sanding belt passes; and a support beam is mounted on said support bracket and extends adjacent said sanding belt and in contact with said cleaning cartridge to support an edge of said cleaning cartridge in contact with said sanding belt.

6. The cleaning unit defined in claim 2 wherein:

said fluid-operated cylinder is manually controlled by a control valve or by a series of mechanical levers.

7. A wide belt sanding machine having an entry end and an exit end, said sanding machine including:

a sanding belt having an abrasive surface and passing over a top roller supported in bearings mounted in bearing supports in said machine;

said sanding machine including a cleaning cartridge pivotally mounted on support brackets attached to said bearing supports;

means mounted on said sanding machine for pivoting said cleaning cartridge to apply and remove said cleaning cartridge to and from said abrasive surface of said sanding belt;

a cartridge support beam mounted on said support brackets;

said support beam being positioned adjacent said sanding belt in contact with the cleaning cartridge;

said means for pivoting said cleaning cartridge includes a fluid-operated cylinder controlled by at least one photoelectric switch or microswitch on at least one of an entry and exit end of the sanding machine, whereby said cleaning cartridge is only applied to said abrasive surface during a sanding operation.

* * * * *